United States Patent [19]

Sosinski et al.

[11] Patent Number: 4,669,853

[45] Date of Patent: Jun. 2, 1987

[54] AUTOMATIC BUCKLE ADJUST

[75] Inventors: Ronald T. Sosinski, Rochester; Chi-Chang Lu; John Maksymiak, both of Penfield, all of N.Y.

[73] Assignee: Xerox Corporation, Stamford, Conn.

[21] Appl. No.: 795,585

[22] Filed: Nov. 6, 1985

[51] Int. Cl.[4] ..... G03G 21/00; G03G 13/00

[52] U.S. Cl. ..... 355/3 SH; 271/188

[58] Field of Search ..... 355/3 R, 3 SH, 3 TR, 355/14 SH, 14 TR, 77, 133; 271/188

[56] References Cited

U.S. PATENT DOCUMENTS 3,963,339 6/1976 Taylor et al. ..... 355/3 SH 4,025,187 5/1977 Taylor et al. ..... 355/14 SH

*Primary Examiner*—Fred L. Braun

*Attorney, Agent, or Firm*—R. F. Chapuran

[57] ABSTRACT

A buckle adjust procedure that automatically adjusts the amount of buckle introduced into copy sheets. The buckle adjust procedure includes the measurement of the time period for the trail edge of a first set of buckled copy sheets at the registration station to pass under a pre-registration switch. A second measurement is made of a time period for the trail edge of a second set of unbuckled copy sheets to pass under the pre-registration switch. The two time periods are compared and if the difference exceeds an acceptable range, an automatic adjustment is made to the amount of buckle introduced into copy sheets. The amount of buckle is determined by the time period that the copy sheets are driven into braked registration rolls.

9 Claims, 4 Drawing Figures

AUTOMATIC BUCKLE ADJUST FLOWCHART

AUTOMATIC BUCKLE ADJUST

This invention relates to an electronic control, in particular, to a control of a printing machine having an automatic copy sheet buckle adjust.

It is often desirable in xerographic printing machines to introduce a suitable amount of buckle in the copy sheets, particularly at the registration station. A suitable amount of buckle often reduces skew and misalignment of copy sheets when sheets are fed from the transport rollers. On the other hand, too much buckle may cause the sheets to be fed too fast and cause misregistration.

The amount of buckle introduced into the copy sheets in the prior art is often variable and unpredictable and often deviates from a suitable buckle to the detrimental operation of the machine. The variation in the buckle is often caused by different characteristics of components of the machine such as switches, clutches and motors. Attempts to correct or establish the correct amount of buckle often required a great deal of manual manipulation and measurement by a service representative. This can be time consuming and costly.

It would be desirable, therefore, to provide a buckle adjust system that compensates for the deterioration and wear of the various machine components that cause variation in the amount of buckle. It would also be desirable to provide a buckle adjust procedure that is relatively simple and inexpensive and minimizes the amount of interaction of a service representative with the machine to correct and adjust for deviation from a standard copy sheet buckle.

It is, therefore, an object of the present invention to provide a new and improved buckle adjust technique. It is another object of the present invention to provide a buckle adjust procedure that minimizes service representative time and that is simple to implement. It is still another object of the present invention to provide a buckle adjust system or procedure that is reliable in monitoring and adjusting the amount of buckle in copy sheets in a printer or reproduction machine.

Further advantages of the present invention will become apparent as the following description proceeds, and the features characterizing the invention will be pointed out with particularity in the claims annexed to and forming a part of this specification.

Briefly, the present invention is a buckle adjust procedure that automatically adjusts the amount of buckle introduced into copy sheets. The buckle adjust procedure includes the measurement of the time period for the trail edge of a first set of buckled copy sheets at the registration station to pass under a pre-registration switch. A second measurement is made of the time period for the trail edge of a second set of unbuckled copy sheets to pass under the pre-registration switch. The two time periods are compared and if the difference exceeds an acceptable range, an automatic adjustment is made to the amount of buckle introduced into copy sheets. The amount of buckle is determined by the time period that the copy sheets are driven into the brake registration rolls.

For a better understanding of the present invention, reference may be had to the accompanying drawings wherein the same reference numerals have been applied to like parts and wherein.

Figure 1:
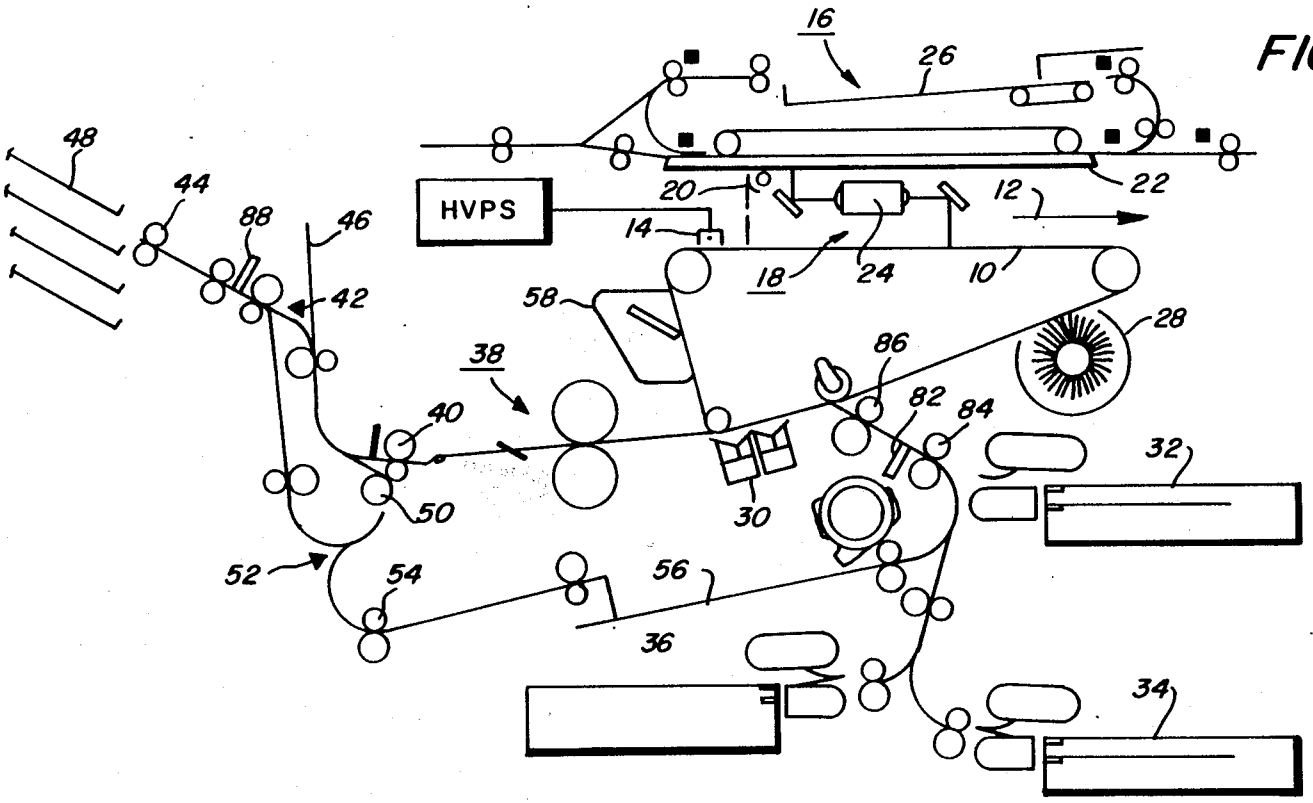
FIG. 1 is an elevational view of a xerographic printing machine incorporating the present invention.

With reference to FIG. 1, there is shown an electrophotographic printing or reproduction machine employing a belt 10 having a photoconductive surface. Belt 10 moves in the direction of arrow 12 to advance successive portions of the photoconductive surface through various processing stations, starting with a charging station including a corona generating device 14. The corona generating device charges the photoconductive surface to a relatively high substantially uniform potential.

The charged portion of the photoconductive surface is then advanced through an imaging station. At the imaging station, a document handling unit 16 positions an original document face down over exposure system 18. The exposure system 18 includes lamp 20 illuminating the document positioned on transparent platen 22. The light rays relfected from document are transmitted through lens 24. Lens 24 focuses the light image of original document onto the charge portion of the photoconductive surface of belt 10 to selectively dissipate the charge. This records an electrostatic latent image on the photoconductive surface corresponding to the informational areas contained within the original document.

Document handling unit 16 sequentially feeds documents from a holding tray 26, in seriatim, to platen 22. The document handling unit recirculates documents back to the stack supported on the tray. Thereafter, belt 10 advances the electrostatic latent image recorded on the photoconductive surface to a development station.

At the development station a magnetic brush developer roller 28 advances a developer material into contact with the electrostatic latent image. The latent image attracts toner particles from the carrier granules of the developer material to form a toner powder image on the photoconductive surface of belt 10.

After the electrostatic latent image recorded on the photoconductive surface of belt 10 is developed, belt 10 advances the toner powder image to the transfer station. At the transfer station a copy sheet is moved into contact with the toner powder image. The transfer station includes a corona generating device 30 which sprays ions onto the backside of the copy sheet. This attracts the toner powder image from the photoconductive surface of belt 10 to the sheet.

The copy sheets are fed from a selected one of trays 32, 34, or 36 to the transfer station. After transfer, sheets are advanced to a fusing station. The fusing station includes a fuser assembly for permanently affixing the transferred powder image to the copy sheet. Preferably, fuser assembly 38 includes heated fuser roller and backup roller with the sheet passing between fuser roller and backup roller.

After fusing, conveyor 40 transports the sheets to gate 42 which functions as an inverter selector. Depending upon the position of gate 42, the copy sheets will either be deflected to an output tray 48 over drive rolls 44 or driven up the transport 46. If a sheet is driven onto transport 46, the trailing edge of the sheet upon passing drive rolls 40, drops into engagement with drive rollers 50. At this point, the sheet will be driven to gate 52.

Decision gate 52 deflects the sheet directly into output tray 48 in an inverted mode or deflects the sheets into a duplex roll transport 54 to duplex tray 56. Duplex tray 56 provides intermediate or buffer storage for those sheets which have been printed on one side for printing on the opposite side. In order to complete duplex copying, the previously simplexed sheets in tray 56 are fed in, seriatim, back to the transfer station for transfer of the toner powder image to the opposed side of the sheet. Invariably after the copy sheet is separated from the photoconductive surface of belt 10, some residual particles remain adhering to belt 10. These residual particles are removed from the photoconductive surface thereof at a cleaning station 58.

Figure 2:
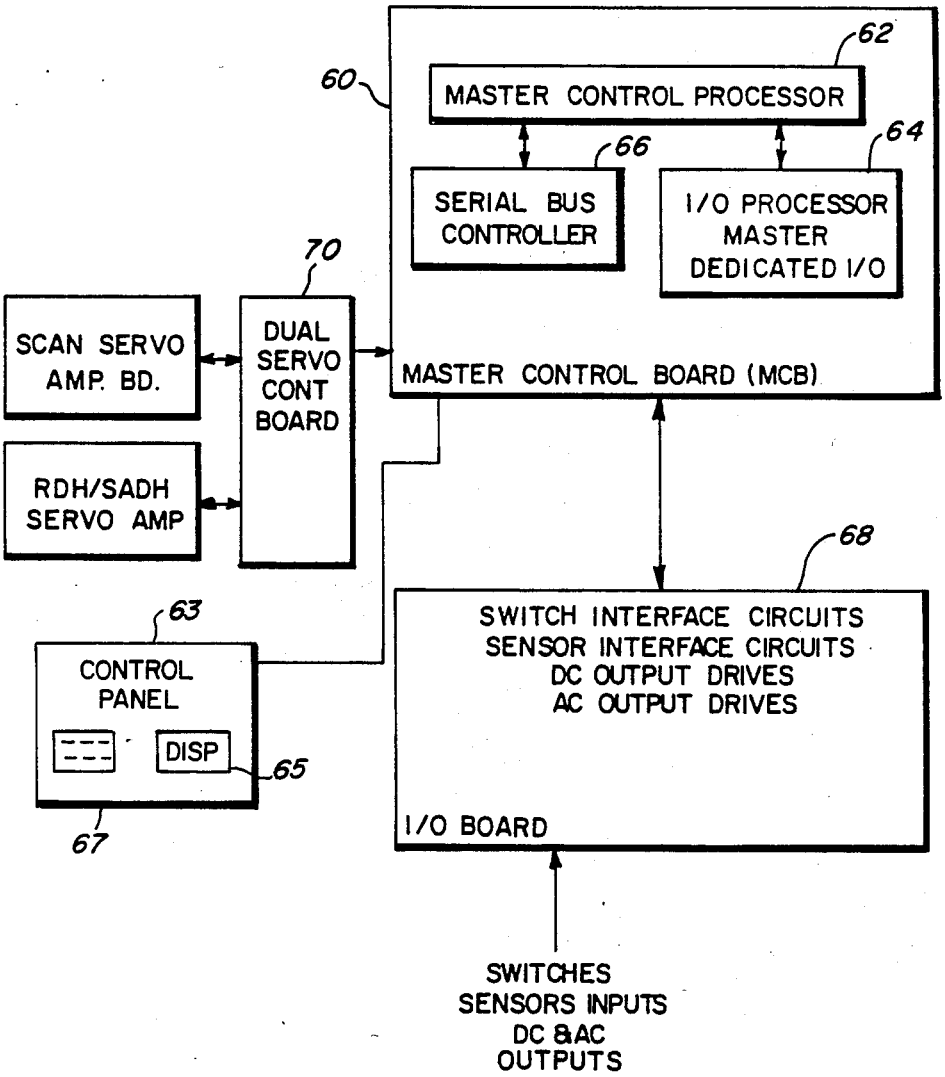
FIG. 2 is a block diagram of the control of the xerographic printing machine as illustrated in FIG. 1.

With reference to FIG. 2, there is illustrated the general control of the xerographic printing machine, in particular a master control board 60, including an Intel 8085 master control processor 62, an Intel 8085 input-/output processor 64 and a serial bus controlled 66 connected to an input/output board 68 including various switch and sensor interface circuits and DC and AC output drivers. In a preferred embodiment, the master control processor includes 80K ROM and 8K RAM and 2K MBM memories and suitable timing and reset circuitry. The input/output processor includes 8K ROM and 2K RAM, AD and DA converters and a 8253 timer and 8259 interrupt controller, as well as suitable input and output ports. The master control board 60 is also connected to a dual servo control board 70 over a serial bus for handling scan and document handling servos. Also connected to the master control board 60 is a control panel 63 with suitable display 65 and key board 67 for entering program data and displaying control and diagnostic information.

Figure 3:
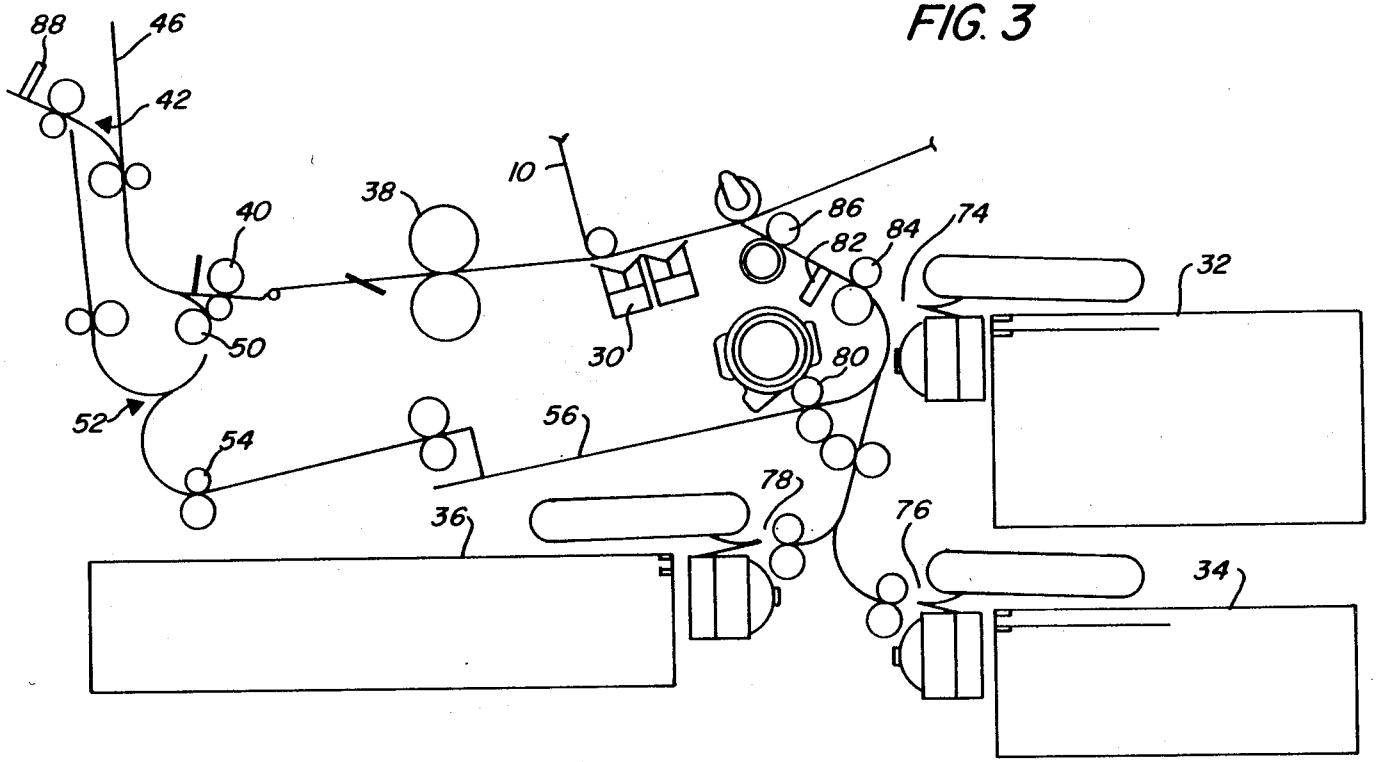
FIG. 3 is an exploded view of the copy sheet paper path of the machine illustrated in FIG. 1.
Figure 4:
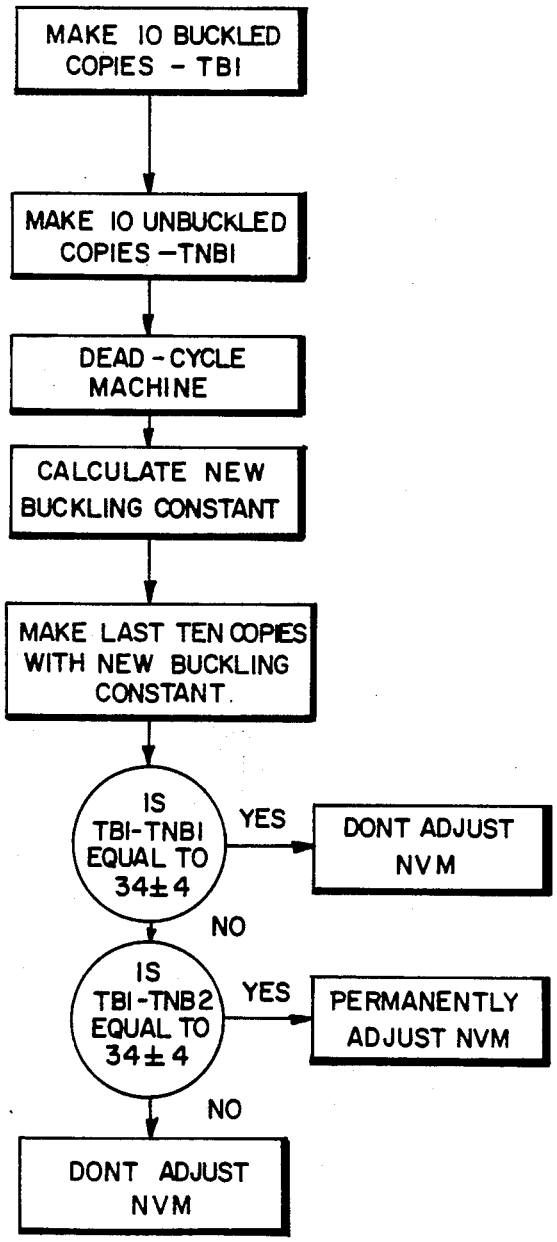
FIG. 4 is a flow chart in accordance with the present invention for automatically adjusting the copy sheet buckle for sheets conveyed in the machine illustrated in FIG. 1.

With reference to FIG. 3, there is shown 3 copy sheet trays, 32, 34 and 36 for supplying copy sheets to be driven by drives 74, 76, and 78 to the transfer station at the photoreceptor belt. In a preferred embodiment tray 32 holds 1100 $8\frac{1}{2}\times 11$ inch cut sheets, tray 34 holds 600 $8\frac{1}{2}\times 11$ inch cut sheets, and tray 36 holds 600 sheets with a variable size of $5\frac{1}{2}\times 8\frac{1}{2}$ inch to $11\times 17$ inch. Sheets from each of these copy trays are pulled onto the associated drives by associated vacuum feed heads as illustrated. In addition, there is a duplex tray having sheets driven by a bottom vacuum corrugated feeder onto the associated drive rollers 80.

There is a pre-registration switch 82 for sensing the presence of copy sheets at the pre-registration station. The pre-registration drive rolls 84 and each of the drivers associated with a copy sheet trays are driven by a (not shown) servo motor. Registration drive rolls 86 are braked and started via a (not shown) clutch connected to a clutch motor. Following transfer, the sheets are driven to the fuser station 38 and through suitable drive rolls past exit switch 88 to an output tray. The output tray can be sorter bins or a compiler station for finishing. The output tray can be an output catch tray.

Preferably, the lead edge of the copy sheet trips the pre-registration switch 82 which begins a clock count or time period. The time period is a predetermined time, as set in the non-volatile memory, to continue driving the copy sheet from the pre-registration rolls 84 into the registration rolls 86. If the registration rolls 86 are braked, and the paper is continued to be driven into the registration rolls, there is a warp or paper buckle introduced into the copy sheet. The amount of buckle is a function of the time from which the lead edge of the copy sheet trips the pre-registration switch 82 until the servo drive is shut off. When the servo drive is shut off, the copy sheet is no longer driven into registration rolls 86. This buckle process deskews the sheet and places the lead edge in proper spacial relationship to provide proper lead edge registration.

When the copy sheets are suitably registered at the registration rolls, and after the servo drive has been shut off, the registration rolls 86 are clutched into operation. When the servo motor is energized, the copy sheet with the buckle is driven through the registration rolls 86 and into engagement with the photoreceptor for the transfer of the latent image onto the copy sheet.

In accordance with the present invention, there is an automatic adjustment of the degree of buckle introduced into the copy sheet at the registration station.

Depending upon the buckle that has been introduced into the copy sheet at the registration rolls 86 while the registration rolls 86 are braked, the time period for the trailing edge of the buckled copy sheet to pass under the pre-registration switch once the registration rolls have been activated varies. In other words, the trailing edge of an unbuckled sheet at the registration rolls will be driven past the pre-registration switch at a first speed and will take (X) amount of time. A buckled sheet at the registration rolls will require a second time speed and take another time period (Y) for its trail edge to pass under the pre-registration switch.

In a preferred embodiment, a service representative places the machine into a diagnostic mode for buckle adjustment and the machine then automatically processes 3 sets of copy sheets. The first set receives the normal copy sheet buckle based on the preset time period in memory for driving the copy sheets into the braked registration rolls. For each of these buckled sheets, there is then a time measurement $T_1$ made from the time that the registration rolls and servo are energized or activated to the time for the trail edge of the copy sheet to drop off at the pre-registration switch. At this time, of course, when the trail edge of the copy sheet has passed the pre-registration switch, the buckle has been dissipated and the sheet is flat.

The second measurement is made for a second set of copy sheets without any buckle having been introduced into the copy sheet. In other words, the registration rolls 86 are not braked and, therefore, the leading edge of the copy sheet extends beyond the registration rolls to flatten out the copy sheet and leave no buckle in the copy sheet. Again, the time period is measured from the time that the registration rolls 86 and servo are energized for the trail edge of the copy sheet, which is at the approximate same location as the trail edge of the previous set of copy sheets to pass under the registration switch 82. This time period, $T_2$, is generally less than time period $T_1$ because there is no additional time period needed for the sheet to lose its buckle before advancing past the switch 82. Time period $T_2$ is compared to the time period $T_1$. If the difference between $T_1$ and $T_2$ is within a pre-given range, then no adjustment is made. However, if the difference is beyond the pre-given range, a new time period for buckle is automatically determined.

The new time period is automatically stored in the non-volatile memory. This is the new time period that the copy sheet is to be driven against the braked registration rolls to provide the buckle. In a preferred embodiment, if X is the time period for an unbuckled sheet to pass by the registration switch, X+34 milliseconds is the preferred time period for a properly buckled sheet to pass by the pre-registration switch.

Specifically, 10 buckled sheets are first timed for the activation of the pre-registration rolls until the trail edge of the copy sheet passes under the pre-registration rolls. The average time is determined (assume the average time to be 600 milliseconds). Then 10 unbuckled sheets are timed or measured and an average taken from the time the sheet leaves the pre-registration rolls until the trail edge passes under the pre-registration switch. Assume the average is 566 milliseconds. The difference is 34 milliseconds and in a preferred embodiment if the difference is 34 plus or minus 4 milliseconds, there is a suitable amount of buckle in the copy sheets and no adjustment is made.

However, if the difference is not within the range 34 plus or minus 4 milliseconds, a new value or buckle time must be determined to add or subtract buckle to the copy sheets. A new buckle value is calculated based upon the amount of difference above or below the standard buckle time and this new value replaces the old value in the non-volatile memory. A check is then made with this new value using unbuckled sheets.

In particular, the procedure is initiated by entering a procedure identification number into the system from the control panel by any well known means. When the procedure identification is entered, the following message will be displayed:

DC38 AUTO BUCKLE ADJUSTMENT

PRESS START TO BEGIN

Actuation of the "START" button initiates a 30 copy run, with the paper sourced from TRAY 32. The time from registration servo actuation until trail edge departure at pre-registration switch is recorded for the first ten sheets, using normal paper timing. The next ten copies are made with no buckle while keeping other timing parameters constant. The time from registration servo actuation until trail edge departure at pre-registration switch is also recorded for these ten sheets.

The average time is calculated for both copy runs and is used to determine if the buckle should be adjusted. This is done by comparing the difference between the average time buckled and the average time not buckled to the NVM variable. Note that the machine will dead-cycle after the first twenty scans in order for the timing to be completed and the averages to be calculated. However, the last ten copies are run and the following message is displayed:

BUCKLE ALREADY AT PROPER VALUE

NO ADJUSTMENT MADE

If the difference is not within this range then a new NVM buckle value is calculated and the last ten copies of the run are delivered. The same timing values are taken for these last ten copies. Then this average is compared against the previous average from the first ten sheets. It is determined whether the new buckle resulted in an acceptable average difference by the same conditions as above. If still an invalid result occurs the NVM buckle variable will not be permanently adjusted and a message similar to the following message will be displayed, where "XXX" is the difference between the average of the first and last ten copies.

UNABLE TO ADJUST BUCKLE

TIMING=XXX

If the difference between the averages of the first and last ten copies is within the prescribed range, then the following message is displayed at the end of the run. "XXX" is the newly calculated buckling value that has been stored in the NVM variable.

NEW NVM BUCKLE

ADJUSTMENT=XXX

If at any time during this routine "STOP" is pressed, the copy run will be terminated with no calculations made.

It should be noted, although in a preferred embodiment, a service representative initially places the printing machine into a diagnostic mode to introduce the buckle measurement procedure, many other variations of this buckle adjustment are contemplated within the scope of this invention. For example, the machine could be programmed or controlled to periodically run a buckle adjust procedure during standby before normal operation or immediately after normal operation of the machine without the necessity of entering into a diagnostic mode.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

We claim:

1. In a xerographic printing machine having a photoreceptor and a plurality of operating components cooperating with one another to produce images on copy sheets, one of the components being a pair of drive rolls for registering the copy sheets at a registration station, each of the copy sheets provided with a given amount of buckle by driving the copy sheets onto the drive rolls, and including a control having a processor with memory, the memory storing a reference representing the amount of buckle introduced into each of the copy sheets, determined by the amount of time the top sheet is driven into the drive rolls, the method of monitoring the amount of buckle provided, comprising the steps of running a first set of buckled copy sheets from the registration station, determining a first time period of copy sheet feed based on said first set, running a second set of unbuckled copy sheets from the registration station, providing a second time period of copy sheet feed based on said second set of copy sheets, comparing the first and second time periods, and adjusting the reference stored in memory for introducing buckle into copy sheets if the difference between the first time period and the second time period is greater than a given range of difference.

2. The method of claim 1 wherein the reference is stored in non-volatile memory.

3. The method of claim 1 including the step of manually entering a diagnostic mode to run said first set and said second set.

4. The method of claim 1 including the step of periodically running said first set and said second set automatically.

5. The method of claim 1 including a registration switch disposed at the registration station and wherein the time period of copy sheet feed is the time for the copy sheet stopped at the drive rolls to be driven to the point that the trailing edge of the copy sheet is sensed by the registration switch.

6. In a xerographic printing machine having a photoreceptor and a plurality of operating components including a registration station cooperating with one another to produce images on copy sheets, and including a control having a processor with memory, the memory storing a reference representing the amount of buckle introduced into each of the copy sheets, the method of adjusting the amount of buckle introduced into the copy sheets comprising the steps of running a buckled copy sheet to the registration station, determining a first time period of copy sheet feed based on said buckled copy sheet, running an unbuckled copy sheet to the registration station, providing a second time period of copy sheet feed based on the unbuckled copy sheet, comparing the first and second time periods, and adjusting the reference stored in memory for introducing buckle into copy sheets if the difference between the first time period and the second time period exceeds a predetermined value.

7. In a xerographic printing machine having a photoreceptor and a plurality of operating components including a registration station having a pair of registration rolls and a registration switch, and a plurality of copy sheet drive rolls, the copy sheet drive rolls adapted to drive copy sheets into engagement with the registration rolls for a given period of time to introduce a degree of buckle into the copy sheets, the method of adjusting the amount of buckle introduced into the copy sheets comprising the steps of driving a buckled copy sheet from the registration station, measuring the time from the activation of the registration rolls until the sensing of the trail edge of the copy sheet of the pre-registration switch for a buckled sheet, driving an unbuckled copy sheet from the registration station, measuring the time period from the time of the activation of the registration rolls until the sensing of the trail edge of the unbuckled copy sheet at the registration switch, determining that the difference in time periods with the buckled sheet and the unbuckled sheets to be outside a given range, and readjusting said given period of time for introducing buckle into the copy sheet.

8. The method of claim 7 including the step of driving said copy sheets into engagement with the registration rolls for said readjusted time period.

9. In a xerographic printing machine having a plurality of operating components including a registration station having a pair of registration rolls, a sensor, and a copy sheet drive adapted to drive copy sheets into engagement with the registration rolls to introduce a degree of buckle into the copy sheets, the method of adjusting the amount of buckle introduced into the copy sheets comprising the steps of driving a buckle sheet from the registration station and measuring the time until the sensing of the copy sheet at the sensor, driving an unbuckled copy sheet from the registration station and measuring the time until the sensing of the unbuckled copy sheet at the sensor, determining that the difference in time periods with the buckled sheet and the unbuckled sheet to be outside a given range, and readjusting the time period for introducing buckle into the copy sheet.

* * * * *